US005951006A

United States Patent [19]

Biegelsen et al.

[11] Patent Number: 5,951,006

[45] Date of Patent: Sep. 14, 1999

[54] MODULAR AIR JET ARRAY WITH COANDA EXHAUSTING FOR MODULE DECOUPLING

[75] Inventors: David Kalman Biegelsen, Portola Valley; Warren Bruce Jackson, San Francisco; Lars Erik Swartz, Sunnyvale, all of Calif.

[73] Assignee: Xerox Corporation, Stamford, Conn.

[21] Appl. No.: 09/083,539

[22] Filed: May 22, 1998

[51] Int. Cl.[6] ..... B65H 29/24

[52] U.S. Cl. ..... 271/195; 406/88; 406/191; 406/192

[58] Field of Search ..... 271/195, 194; 406/86, 88, 191, 192, 154

[56] References Cited

U.S. PATENT DOCUMENTS

| | | | |
|---|---|---|---|
| 3,873,013 | 3/1975 | Stibbe . | |
| 4,201,323 | 5/1980 | Stibbe et al. . | |
| 4,472,888 | 9/1984 | Spiller . | |
| 4,505,412 | 3/1985 | Reba . | |
| 4,601,116 | 7/1986 | Krimsky . | |
| 4,837,947 | 6/1989 | Krieger . | |
| 5,028,173 | 7/1991 | Vits . | |
| 5,149,401 | 9/1992 | Langevin et al. . | |
| 5,213,451 | 5/1993 | Frank et al. | 406/88 X |
| 5,216,224 | 6/1993 | Kozies et al. . | |
| 5,222,726 | 6/1993 | Vits | 271/195 |
| 5,263,700 | 11/1993 | Tubb et al. . | |
| 5,293,946 | 3/1994 | Besson et al. . | |
| 5,299,364 | 4/1994 | Heikkiläet al. . | |
| 5,347,805 | 9/1994 | Butzke et al. . | |
| 5,395,029 | 3/1995 | Kurie . | |
| 5,402,938 | 4/1995 | Sweeney . | |
| 5,606,805 | 3/1997 | Meyer . | |
| 5,634,636 | 6/1997 | Jackson et al. | 271/225 |

OTHER PUBLICATIONS

P. Kundu, Fluid Mechanics, Academic Press 1990, pp. 318–322.

*Primary Examiner*—David H. Bollinger
*Attorney, Agent, or Firm*—Oliff & Berridge, PLC

[57] ABSTRACT

A decoupling mechanism is provided for passively or actively decoupling an exhaust from a modular air transport system by diverting an amount of air exiting a channel in a first module in a direction other than the process direction through use of the Coanda effect. This decouples the amount of air from a downstream module. This is achieved by providing edge surfaces of the channel outlet, formed on top and bottom plates of the first air module, so that one of the two edge surfaces has a larger radius of curvature than the other. An air vent formed by a gap between the other of the edges and the second module is also provided to assist in the Coanda effect.

21 Claims, 4 Drawing Sheets

MODULAR AIR JET ARRAY WITH COANDA EXHAUSTING FOR MODULE DECOUPLING

BACKGROUND OF THE INVENTION

1. Field of Invention

This invention generally relates to decoupling of air in a modular air jet array. More particularly, the invention relates to decoupling of air between closely spaced modules by use of the Coanda effect.

2. Description of Related Art

Air jet modules are known to provide motive forces to transport objects, such as paper, from one location to another. However, air jet modules using non-cellularized sources produce significant downstream flows. Downstream modules can be affected by the exhaust stream of upstream modules, making control difficult or unstable.

SUMMARY OF THE INVENTION

There is a need for a device or structure that decouples an air jet exhaust exiting one module prior to an entrance into an adjacent downstream module. There also is a need for such a device or structure that can be switched on or off to selectively enable decoupling. Further, there is a need for such a device or structure that does not impede the travel of media, such as paper, through the modules. That is, the device or structure must not divert the travel direction of the media.

This invention provides a device structure that decouples an air jet exhaust exiting one module from entering an entrance of an adjacent downstream module.

This invention further provides a device structure that can selectively turn on and off the decoupling of the exiting air jet from the downstream module.

This invention also provides a device structure that does not impede the travel of a transported medium between the upstream and downstream modules.

In particular, this invention includes a modular transport system for transporting thin film media comprising at least a first air module and a second module, an outlet of the first air module being closely adjacent and substantially in-line with an inlet of the second module, the first air module comprising: a first plate; a second plate; a thin film media transport channel defined between the first plate and the second plate, the channel having an inlet and an outlet, the channel outlet corresponding to the outlet of the first air module; and at least one air jet conduit connected with a source of pressurized air and exiting into the transport channel, the at least one air jet providing an air flow stream traveling in the transport channel toward the outlet in a first flow direction to propel a thin film media through the first air module and into the second air module, the device structure of this invention including a downstream portion of the first plate adjacent the channel outlet that forms a first corner having a small radius of curvature and a downstream portion of said second plate adjacent the channel outlet that forms a second corner having an increased radius of curvature, a gap existing between an end of the second corner and the inlet of the second module and an air vent being defined between the first plate and the inlet of the second module, the air flow stream through the channel detaching from the first plate at the first corner and following the curvature of the second corner of the second plate due to a Coanda effect to decouple an amount of the air flow stream from the inlet of the second air module, resulting in diversion of the amount of the air flow stream out of the first air module in a second flow direction differing from the first flow direction.

The modular transport system may further comprise a grate member that assists in transporting curled paper or other thin film media. The inlet of a downstream second module preferably has an outwardly diverging inlet to accept and guide the thin film media into the channel of the second module.

Passive or active switching can be provided to enable decoupling of the exiting air from the first module prior to entrance into the second module.

BRIEF DESCRIPTION OF THE DRAWINGS

The invention will be described in relation to the following drawings in which referenced numerals refer to like elements, and wherein.

DETAILED DESCRIPTION OF PREFERRED EMBODIMENTS

Figure 1:
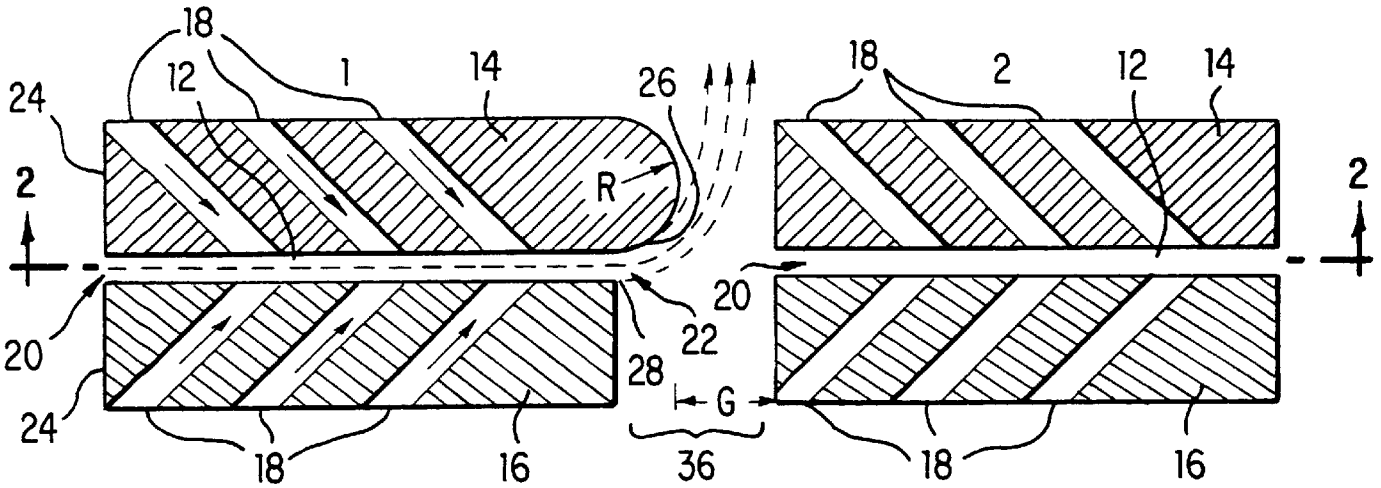
FIG. 1 is a side cross-sectional view of a modular air jet array according to the invention taken along line 1—1 of FIG. 2.
Figure 2:
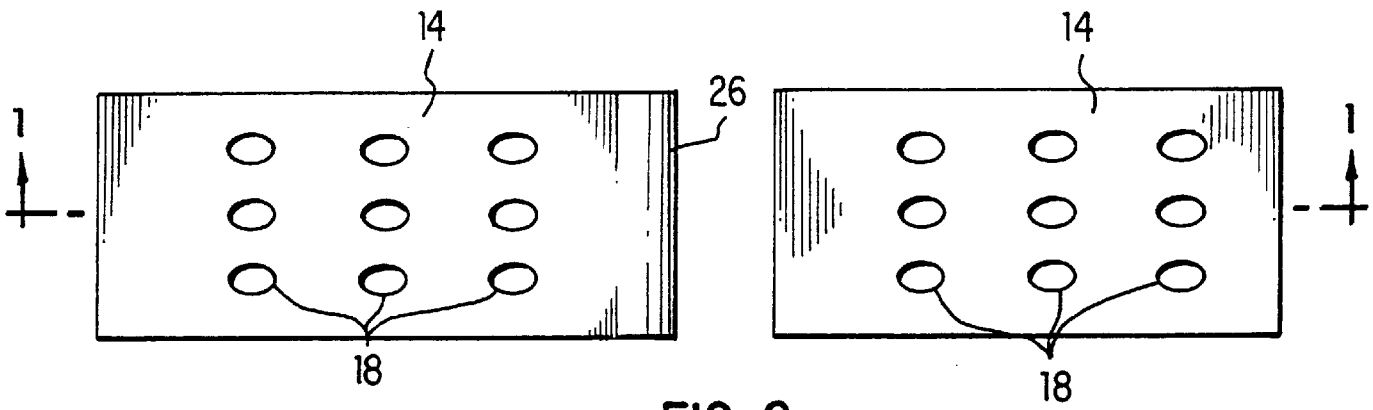
FIG. 2 is a channel view of the modular air jet array of FIG. 1 taken along line 2—2.

With reference to FIGS. 1 and 2, a modular paper handling system 10 is shown having a first module 1 and a second closely adjacent module 2. In this first embodiment, the second downstream module is different in structure from the first module. However, for simplicity and adaptability, they may have identical structure. While two modules are shown, the inventive concept applies to any number of such module pairs. The first module 1 includes a channel 12 defined between a top plate 14 and a bottom plate 16. An array of air jets 18 are provided in communication with the channel 12 to provide a movement force for a medium traveling through the channel 12, such as paper or other thin film media including films and transparencies, from a channel inlet 20 to a channel outlet 22. While a 3×3 air jet array is shown for simplicity of illustration, a preferred exemplary air jet array comprises an 8 row×6 column array provided in both the top plate 14 and the bottom plate 16. The arrays of air jets 18 are in communication with a source of pressurized air. However, the specific arrangement of air jets is not critical to the invention and may be altered depending on specific system requirements. What is required of the air jet array is sufficient air flow to propel a desired object through the channel to any subsequent downstream module. A suitable air module can be found in U.S. Pat. No. 5,634,636 to Jackson et al., the disclosure of which is incorporated herein by reference in its entirety.

The front face of each module at the inlet 20 can have any suitable structure, such as flat end walls 24 provided on both the top plate 14 and the bottom plate 16. The rear face of the first module 1 is designed to create a "Coanda effect" in the airstream exiting from the channel 12. The "Coanda effect" is a phenomenon where streams of air traveling along a straight path will adhere to and follow a curved surface, rather than continuing on the straight path.

On exiting a confined channel, the "Coanda effect" is achieved by making a first edge 26 with a larger radius of curvature than a second edge 28. While the first edge and second edge are shown to be on the top plate 14 and the bottom plate 16, respectively, the Coanda effect would work equally well with the edges 28 and 26 reversed. The result would be an exhaust flow exiting downward, rather than upward as shown. This may be preferable depending on the particular application on which the inventive exhausting is used. Furthermore, jets in a given module may also be arranged so that a net flow occurs selectively in either direction. Then, the same Coanda effect arrangement can be utilized at each end of the module.

In the first embodiment, second edge 28 is an abrupt edge, illustrated as a 90° corner that is perpendicular to the channel, forming a radius of curvature of 0. The first edge 26 has an exemplary radius of curvature of about ¼" for peak air velocities less than about 50 m/s. An air gap G exists between the end of the first module and the beginning of the second module. Preferably, this air gap is at least ⅓" to allow for adequate deflection of the air exhaust to allow decoupling of air between the modules. The channel height is preferably about ⅛", but may vary.

A test was conducted to establish the effectiveness of this structure to decouple the airstream. Tables 1–4 show the results of the test using an air jet module configuration shown in FIG. 3. The test air module is the same as the first module shown in FIG. 1. To establish flow velocities of the exiting air exhaust from the air module, an anemometer wire was held in a vertical position shown by arrow y. The anemometer was located 1" from the end of the air module in the process direction. Various flow velocities were experimented with to determine suitability of the Coanda effect for decoupling exiting air from between adjacent air modules.

As illustrated, the vertical value of dimension y corresponding to the plane of the first process direction is 0 cm. Thus, values of y greater than 0 are located above the plane of the process direction and values below 0 are located below the plane of the process direction. As the data show, the higher the flow rate, the more the air flow is diverted. For example, Table 1 shows a peak air flow exit velocity at 10.8 cm above the process direction plane, at a channel flow of 10 scfm (standard cubic feet per minute). However, when channel flow is reduced to 1.25 scfm, the peak exiting air flow occurs at 0.4 cm above the process direction plane. Thus, at this low flow, a large portion of the air stream remains substantially parallel with the process direction plane.

These tests establish that the inventive end structure of an air module effectively deflects the exiting exhaust. As such, this structure is able to decouple the exiting air stream from one module prior to its entrance into an adjacent downstream module due to the airstream detaching from the lower plate and following the curve of the upper plate. Thus, an exiting exhaust traveling in a first process direction substantially parallel to the channel can be redirected to a second non-parallel direction preventing its entrance into the downstream module. While it is preferable to have as much air as possible diverted, it is not necessary to redirect all of the air flow. Thus, only a certain amount may need to be redirected.

TABLE 1

| FLOW | V(y) [m/sec] | y [cm] |
|---|---|---|
| 10 scfm | 0.1 | −1.25 |
| | 0.25 | −.55 |
| | 0.40 | 0 |
| | 0.50 | +.35 |
| | 0.60 | +5.25 |
| | 1.00 | +6.15 |
| | 2.00 | +7.85 |
| | 3.00 (peak) | +10.85 |
| | 2.00 | +15.45 |

TABLE 2

| FLOW | V(y) [m/sec] | y [cm] |
|---|---|---|
| 5 scfm | 0.10 | +4.05 |
| | 0.30 | +4.25 |
| | 0.60 | +5.15 |
| | 1.00 | +5.85 |
| | 1.10 (peak) | +7.05 |
| | 0.10 | +13.85 |

TABLE 3

| FLOW | V(y) [m/sec] | y [cm] |
|---|---|---|
| 2.50 scfm | 1.00 (peak) | +2.75 |
| | 0.10 | +1.85 |

TABLE 4

| FLOW | V(y) [m/sec] | y [cm] |
|---|---|---|
| 1.25 scfm | 0.40 (peak) | +.45 |
| | 0.05 | 0 |

Figure 3:
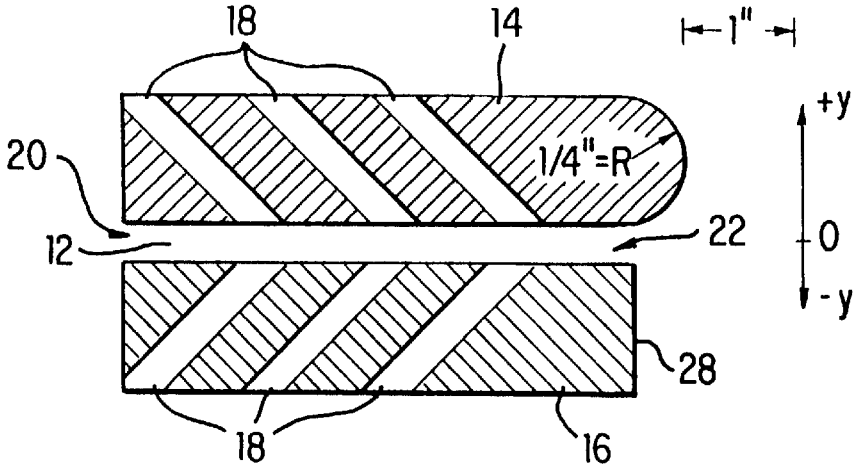
FIG. 3 is a side cross-sectional view of a modular air jet array used to test the effectiveness of the invention.
Figure 4:
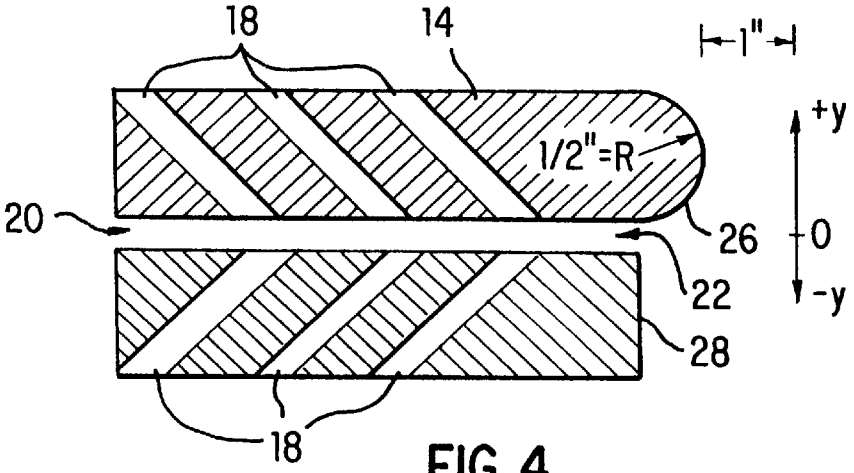
FIG. 4 is a side cross-sectional view of a second modular air jet array used to test the effectiveness of the invention.
Figure 5:
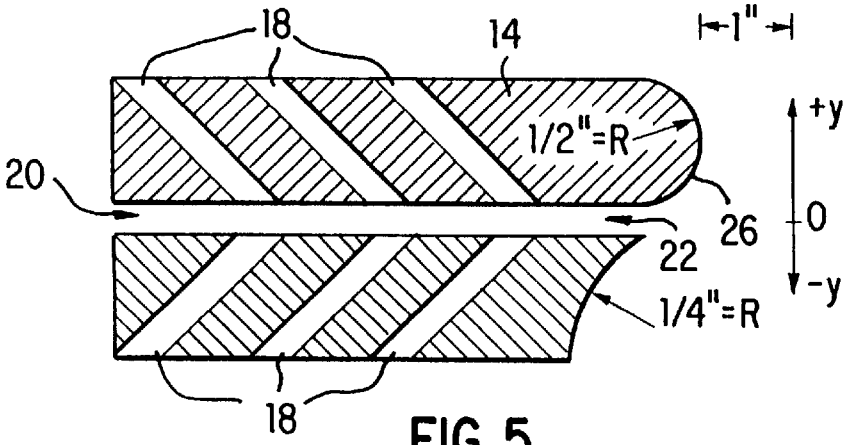
FIG. 5 is a side cross-sectional view of a modified second modular air jet array used to test the effectiveness of the invention.

A second test was conducted using the test module shown in FIG. 4. The main difference between the devices shown in FIGS. 3 and 4 is in the use of an upper radius of curvature of ½" rather than ¼", respectively. Additionally, use of a ¼" concave radius on the bottom plate was substituted for the flat bottom, as shown in FIG. 5. This last substitution did not result in any change. The results are provided in Tables 5–7 and show that at higher flow rates, two peaks could be found. However, diversion of the flow was not achieved at extremely low flow rates, because detachment from the abrupt corner is ineffective at sufficiently low velocities. However, at low velocities there is also no need to decouple upstream air from a downstream module.

TABLE 5

| FLOW | V(y) [m/sec] | y [cm] |
|---|---|---|
| 10 scfm | 0.10 | −1.05 |
| | 0.40 | 0 |
| | 0.80 (2nd peak) | +2.65 |
| | 0.50 | +4.65 |
| | 0.75 | +6.75 |
| | 1.00 | +8.15 |
| | 1.50 (peak) | +10.95 |
| | 1.10 | +16.75 |

TABLE 6

| FLOW | V(y) [m/sec] | y [cm] |
|---|---|---|
| 5 scfm | 0.05 (broad peak) | +1.75 |
| | 0.00 | +3.65 |
| | 0.10 | +5.75 |
| | 0.40 (peak) | +8.95 |

TABLE 7

| FLOW | V(y) [m/sec] | y [cm] |
|---|---|---|
| 2.5 scfm | too low to read | 0 |
| | 0.10 (peak) | +6.75 |

Figure 6:
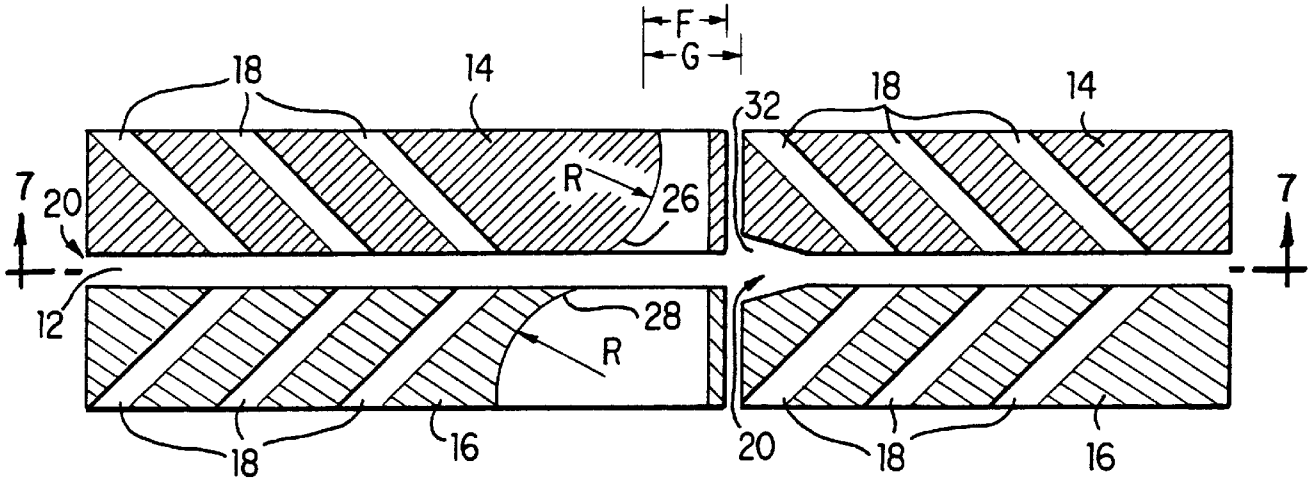
FIG. 6 is a side cross-sectional view of a modular air jet array according to a second embodiment of the invention taken along line 6—6 of FIG. 7 with grate fingers added to the outlet end of the module.
Figure 7:
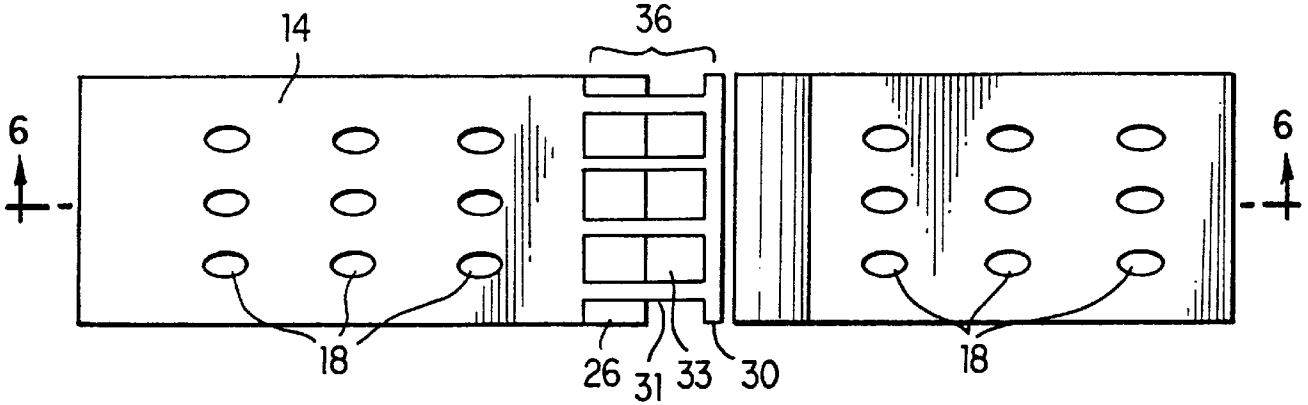
FIG. 7 is a channel view of the modular air jet array of FIG. 6 taken along lines 7—7.

A second more preferred embodiment will be described with reference to FIGS. 6–7. In this embodiment, grate members 30 are provided to assist in travel of the paper, while still allowing the air gap and air vent to operate as in the first embodiment. The grate members 30 can each include several thin finger elements 31 extending in the process direction of the air modules 1 and 2. A gap F of 0.4" is provided between the end of the edge 26 and the end of grate member 30. The grate fingers 31 can have a width of about 1/16"defining openings 33 of about 1/4" therebetween. The edge 28 has a negative radius of about 1/4" or is straight and tilted. The only essential feature is the abrupt change in wall direction to facilitate detachment. Thus, diverted air flows through the openings 33 formed between edge 26 and the fingers 31. Grate structures can be on either or both plates.

When paper is transported through the first module 1 toward the second module 2, the paper is guided by the fingers 31. This structure helps feed paper, including curled paper. Moreover, by providing outwardly diverging entrance walls 32 at the inlet 20 of the downstream module 2, curled paper can be further guided into the second module 2 with lesser chance of a misfeed.

It was found that the Coanda effect can only be achieved when an air vent 36 exists between the bottom plate of the first module and the second module. Thus, it is believed that an air vent is necessary on the bottom plate to assist in formation of the diverted air stream. Ample redirecting of the exiting airstream can be achieved if the air vent 36 on the bottom plate is at least 1/8" (3 mm).

Figure 8:
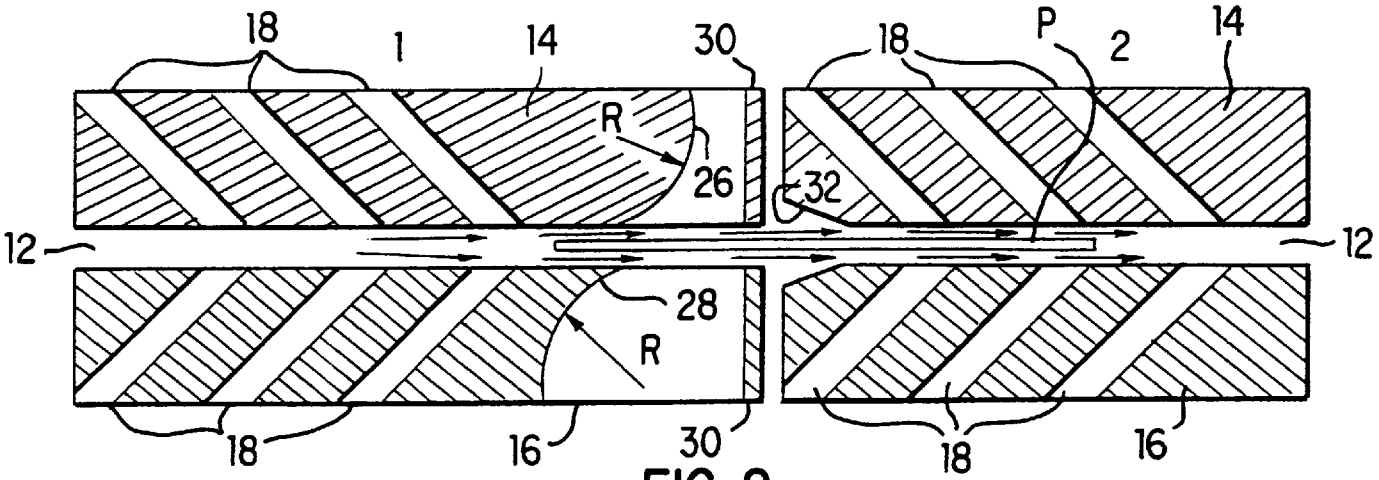
FIG. 8 is the air jet modules of FIG. 5 showing an air flow path when paper is present between the modules.

As shown in FIG. 8, when paper is present in the channel near the outlet 22 of the first module 1, the Coanda effect has been found to naturally be quenched. In such a transition state, in which the paper is between the modules 1 and 2, the air flow attaches to the paper and detaches from the convex radius curved wall. Accordingly, when paper is being fed between the first and second modules 1 and 2, coupling of the air flow between the modules 1 and 2 is retained, which is desirable for proper transporting of the paper. However, once the paper fully enters the second module 2, the exiting airstream from the first module 1 is again decoupled from the second module 2. Thus, when transporting paper, the decoupling structure according to this invention automatically achieves passive switching to either couple or decouple the exiting air flow depending on the presence of paper between the modules 1 and 2. The preferential attachment to the paper sheet occurs successfully for all media with stiffness greater than that of rice paper. For very flexible, light media, the sheet tends to follow the Coanda stream. However, one could use such an effect to sort very flimsy media from stiffer media. Additionally, the grate structures can be used to guide such flimsy media to the downstream module.

Alternatively, active decoupling could be achieved for other applications by selectively opening or closing the air vent 36 on the bottom plate 16. This may be achieved by a valve that modulates the bottom side venting. This could be achieved mechanically by physically changing the air vent size. Alternatively, active switching can be achieved by structure similar to that used in fluidic amplifiers to adjust the air vent.

Figure 9:
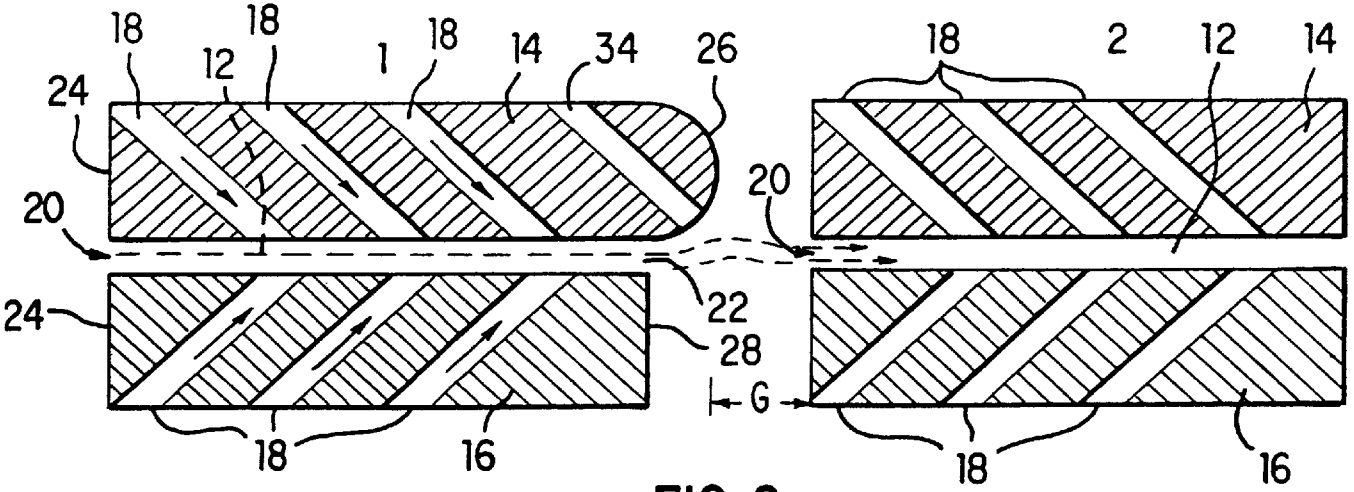
FIG. 9 is an active switching device used to selectively decouple the air flow.

Other equivalent switching means are contemplated, such as the additional air nozzle structure shown in FIG. 9. In this embodiment, active switching can be achieved by placing one or more air jet nozzles 34 in the vicinity of the edge 26. When air jet nozzles 34 are activated, an air pressure force is generated that urges the air stream back toward the first process direction, rather than along the curved surface of the edge 26. Thus, when the nozzles 34 are activated, coupling of the two modules 1 and 2 is retained. When the nozzles 34 are deactivated, decoupling of the exiting airstream is achieved due to the Coanda effect, as in the previous embodiments.

The invention has been described with respect to specific embodiments, which are meant to be illustrative and not exhaustive. Various modifications can be made without departing from the sprit and scope of the invention.

In particular, while the second module is shown to be another air module, this is not necessary. The second module can also take the form of other mechanical modules. In the context of paper transporting in a copier environment, the second module could be a conventional paper feed module having roller pairs or endless belts that transport the paper downstream. Further, the downstream second module could be a photoreceptor, fuser or other similar copier component that could benefit from adaptive decoupling of exiting exhaust from the first module.

What is claimed is:

1. A modular system comprising at least a first air module and a second air module, an outlet of the first air module being closely adjacent and substantially in-line with an inlet of the second air module, the first air module comprising:

a first plate;

a second plate;

a transport channel defined between the first plate and the second plate, the channel having an inlet and an outlet, the transport channel outlet corresponding to the outlet of the first air module; and at least one air jet conduit connected with a source of pressurized air and exiting into the transport channel, the at least one air jet providing an air flow stream traveling in the transport channel toward the outlet in a first flow direction;

wherein a downstream portion of the first plate adjacent the transport channel outlet forms a first corner having a first radius of curvature and a downstream portion of the second plate adjacent the transport channel outlet forms a second corner having a second radius of curvature greater than the first radius of curvature, a gap existing between an end of the second corner and the inlet of the second module and an air vent defined between the first plate and the inlet of the second module, the air flow stream through the transport channel detaching from the first plate at the first corner and following the second corner due to a Coanda effect to decouple an amount of the air flow stream from the inlet of the second air module.

2. The modular system of claim 1, wherein the at least one air jet conduit is located within at least one of the top plate and the bottom plate.

3. The modular system of claim 2, wherein the at least one air jet includes a plurality of air jets located within each of the top plate and the bottom plate.

4. The modular system of claim 1, wherein a thin medium is transported through the transport channel, by the air flow stream, into the inlet of the second air module.

5. The modular system of claim 4, wherein the gap is at least 0.85 cm (⅓").

6. The modular system of claim 4, wherein the gap is about 0.85 cm (⅓").

7. The modular system of claim 4, wherein, when the thin medium is present between the first air module and the second air module, a substantial amount of the air flow stream follows the path of the thin medium into the inlet of the second air module.

8. The modular system of claim 4, wherein, when the thin media is not present between the first air module and the second air module, a substantial amount of the air flow stream follows a path along the second direction.

9. The modular system of claim 1, wherein an end of the downstream portion of at least one of the first plate and the second plate includes a grate member extending toward the second air module.

10. The modular system of claim 9, wherein the inlet of the second air module is outwardly divergent.

11. The modular system of claim 1, wherein the air vent is modulated to prevent substantial decoupling of the air flow stream.

12. The modular system of claim 11, wherein the air vent is passively modulated.

13. The modular system of claim 11, further comprising active switch means for modulating the air vent.

14. The modular system of claim 1, wherein the air vent has a length in the first flow direction of at least ⅛".

15. A modular transport system for transporting thin film media comprising at least a first air module and a second air module, an outlet of the first air module being closely adjacent and substantially in-line with an inlet of the second air module, the first air module comprising:

a first plate;

a second plate;

a thin film media transport channel defined between the first plate and the second plate, the channel having an inlet and an outlet, the channel outlet corresponding to the outlet of the first air module; and at least one air jet conduit connected with a source of pressurized air and exiting into the transport channel, the at least one air jet providing an air flow stream traveling in the transport channel toward the outlet in a first flow direction to propel a thin film medium through the first air module and into the second air module;

wherein a downstream portion of the first plate adjacent the channel outlet forms a first corner having a first radius of curvature and a downstream portion of the second plate adjacent the channel outlet forms a second corner having a second radius of curvature greater than the first radius of curvature, a gap existing between an end of the second corner and the inlet of the second module and an air vent defined between the first plate and the inlet of the second module, the air flow stream through the channel detaching from the first plate at the first corner and following the curvature of the second corner of the second plate due to a Coanda effect to decouple an amount of the air flow stream from the inlet of the second air module.

16. The modular transport system of claim 15, wherein the gap is at least 0.85 cm (⅓").

17. The modular transport system of claim 15, wherein the gap is about 0.85 cm (⅓").

18. The modular transport system of claim 15, wherein when the thin film medium is present between the first air module and the second air module, a substantial amount of the air flow stream follows the path of the thin film medium into the inlet of the second air module.

19. The modular transport system of claim 15, wherein an end of the downstream portion of at least one of the first plate and the second plate includes a grate member extending toward the second air module.

20. The modular system of claim 19, wherein the inlet of the second air module is outwardly divergent.

21. The modular system of claim 15, wherein the air vent is modulated to prevent substantial decoupling of the air flow stream.

* * * * *